United States Patent [19]

Hummer et al.

[11] 4,130,419

[45] Dec. 19, 1978

[54] PROCESS FOR THE PURIFICATION, MODIFICATION AND HEATING OF A CAST-IRON MELT

[75] Inventors: Roland Hummer, Leoben-Göss; Wolfgang Thury; Wilfried Westerholt, both of Leoben, all of Austria; Gundolf Höllerling, Ottobrunn; Reinhard Strigl, Munich, both of Germany

[73] Assignee: Linde AG, Wiesbaden, Germany

[21] Appl. No.: 777,153

[22] Filed: Mar. 11, 1977

[51] Int. Cl.[2] ..... C21C 5/34

[52] U.S. Cl. ..... 75/130 R; 75/60

[58] Field of Search ..... 75/60, 130 R

[56] References Cited

U.S. PATENT DOCUMENTS

| | | | |
|---|---|---|---|
| 3,321,301 | 5/1967 | Bartu | 75/60 |
| 3,723,099 | 3/1973 | Marukawa | 75/60 |
| 3,748,122 | 7/1973 | Ramachamdra | 75/60 |
| 3,749,567 | 7/1973 | Stephenson | 75/60 |

*Primary Examiner*—P. D. Rosenberg

*Attorney, Agent, or Firm*—Karl F. Ross

[57] ABSTRACT

A process for the treatment of a cast-iron melt with oxygen, e.g. for raising the temperature thereof or otherwise modifying the composition of the melt in which the oxygen is introduced directly into the liquid cast iron at a rate (quantity per unit time) so controlled that there is no smoke development above the melt. The control is effected by feeding oxygen into the melt at progressively increasing rates until incipient smoke formation is observed above the melt and then stepping back the oxygen feed until the smoke evolution ceases.

10 Claims, 1 Drawing Figure

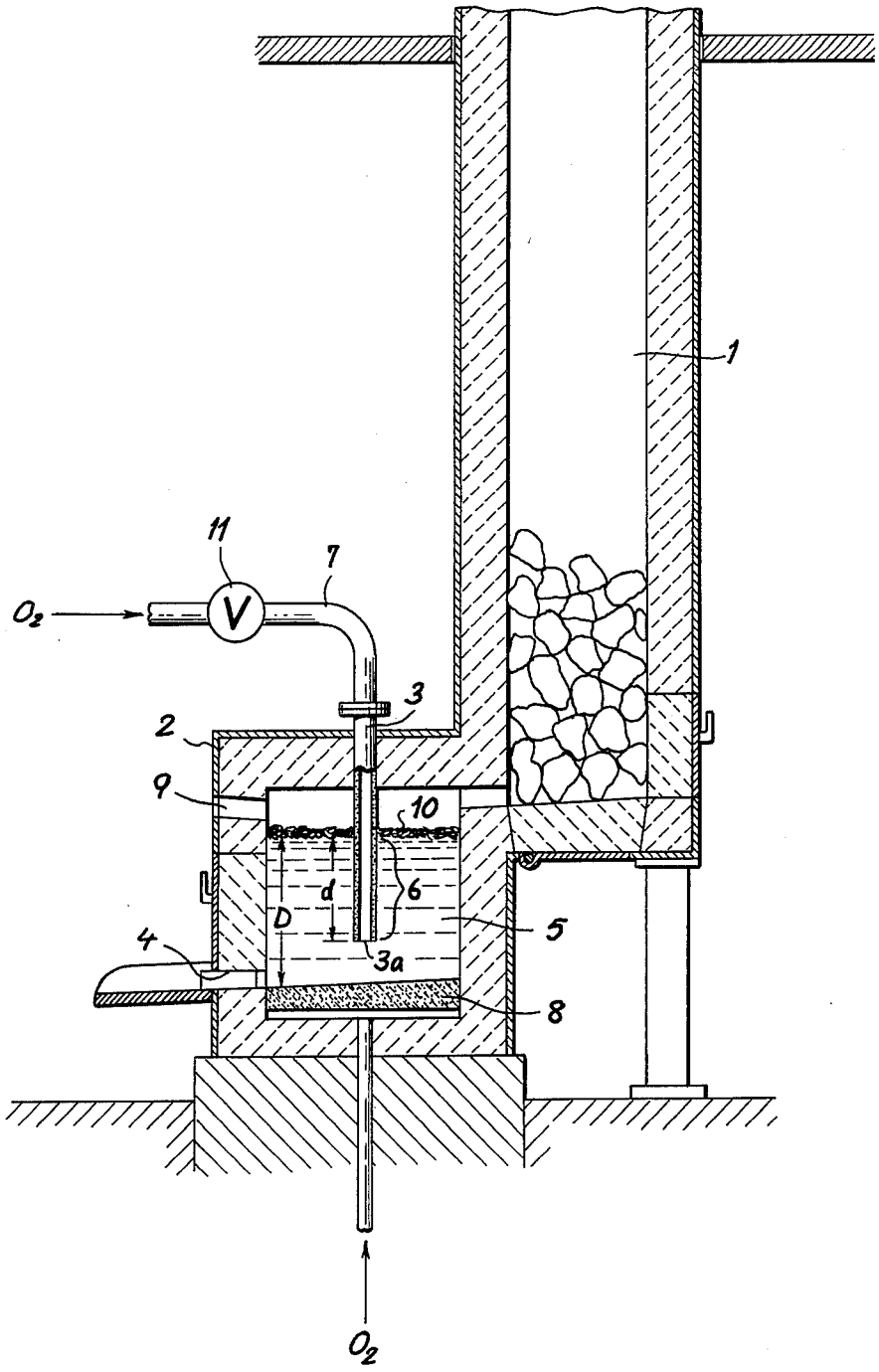
1
11
7
$O_2$
V
3
2
9
10
d
6
D
5
4
3a
8
$O_2$

PROCESS FOR THE PURIFICATION, MODIFICATION AND HEATING OF A CAST-IRON MELT

FIELD OF THE INVENTION

The invention relates to a process for the purification, modification and heating of a cast-iron melt by oxygen treatment and to an apparatus for carrying out this process. More particularly, the invention relates to improvements in the oxygen treatment of cast-iron melts.

BACKGROUND OF THE INVENTION

Processes for the treatment of cast-iron melts are known in which gas, for example air (as an oxygen carrier) or oxygen, is blown onto the surface of a cast-iron melt to effect a movement of the bath such that the metal is swept centrifugally above its normal quiescent surface. This treatment is used to promote the tendency of a given flowable cast-iron melt to solidify as gray cast iron. In this process, however, a strong development of smoke is observed above the melt so that the process can only be employed in foundries provided with gas-evacuating and filtering systems to prevent endangering the health of the operating personnel.

It is also known to provide a process for the refining of steel melts in which oxygen is blown onto the upper surface of a steel melt through a lance (see German open application DT-OS No. 14 33 486). Even in this case a continuing evolution of smoke occurs. The smoke evolution can be positively effected by the lance described in this application although not completely avoided.

In smelters for the preparation of steel melts, therefore, fume-collection and exhaust devices are required and the fume-treatmentsystems are expensive to construct and operate although they are necessary to prevent environmental pollution. However, even the special cleaning devices are not fully satisfactory.

Fume and smoke cleaning and evacuating apparatus of the latter type is not usually provided in cast iron smelters or foundries. If it is desired, therefore, to treat a melt such that smoke evolution may occur, without constructing such evacuating and cleaning apparatus, the process can only be carried out in special furnaces, i.e. the types of furnaces in which smelting can be effected are limited.

Furthermore, it has been found that a larger problem arises in the treatment of a cast-iron melt with a gas, namely, the proper control of the gas flow for an optimum treatment process. If melt temperature is used as the actual value input to a control system for supplying oxygen or another treatment gas to the melt, relatively complex control means must be provided and experiments must be undertaken to determine the relationship between temperature and gas feed. The same holds true with all conventional controlled apparatus for the regulation of gas flow in melt-treatment systems used heretofore.

OBJECTS OF THE INVENTION

It is an object of the present invention to provide a process for the cleaning, purification, modification and temperature raising (heating) of a cast iron melt which has increased versatility and can be carried out without significant capital expenditure in a manner which precludes environmental pollution and detriment to the personnel of the smelter or foundry in which the process is effected.

Another object of the invention is to provide an improved apparatus for the smelting and treating of cast-iron melts.

Still another object of this invention is to provide a process for the oxygen treatment of a cast-iron melt which permits an optimum treatment rate to be maintained with a minimum of control apparatus or equipment.

It is also an object of this invention to provide a method of and an apparatus for the oxygen treatment of a cast-iron melt such that detriment to the environment or the interior of a smelter is precluded.

SUMMARY OF THE INVENTION

These objects and others which will become apparent hereinafter are attained, in accordance with the present invention, in a process for the oxygen treatment of a molten cast-iron mass, i.e. a cast-iron melt, in which oxygen is fed into the melt directly and the rate at which the oxygen is supplied (in terms of quantity, such as mass flow or volume flow per unit time) is so controlled that it is the maximum rate at which oxygen can be fed without smoke evolution, i.e. the development of smoke above the melt. More specifically, the invention resides in the feeding of oxygen directly into a cast iron melt at the maximum rate below that at which smoke evolution commences. Any higher rate would, perforce, result in smoke evolution.

According to the invention, therefore, the oxygen quantity introduced into the melt is such that substantially no free oxygen leaves the melt and hence no carrier gas is provided for any smoke. Reaction products such as FeO, $Fe_2O_3$, $SiO_2$, MnO and the like form a slag or are taken up in a previously provided slag.

The appropriate quantity of oxygen per unit time introduced into the cast-iron melt can be established, in practice, without such measuring devices by gradually increasing the oxygen pressure (and mass flow rate) until incipient smoke development above the cast-iron melt is observed and the pressure thereupon immediately reduced just until smoke evolution ceases.

In cast iron, the degree of saturation $$\frac{\%\ C}{(4.23 - 0.3\%\ Si - 0.3\%\ P)}$$

or the carbon equivalent $$(\%C + \tfrac{1}{3}\%\ Si + \tfrac{1}{3}\%\ P)$$

is a measure of stability. The operation according to the invention is thus carried out by introducing the oxygen into the cast-iron melt under the conditions specified above until a desired value of the degree of saturation or the carbon equivalent of the cast iron is achieved.

Of course the process need not be used exclusively for correcting the degree of saturation or the carbon equivalent of cast iron. It can also be used for the removal of certain impurities which detrimentally effect the quality of the cast bodies. In this case, the oxygen feed is maintained, under the conditions of the invention specified above, until the concentrations of the aforementioned impurities have been reduced to the desired extent. The impurities which have been found to be most effectively removed by the present process are elements which have a high affinity for oxygen and include aluminum and titanium.

Naturally, the introduction of oxygen into the cast-iron melt triggers oxidation reactions in which iron and other elements such as carbon, silicon and manganese are exothermically oxidized, thereby bringing about a temperature increase (heating) of the cast-iron melt. When an introduction is intended primarily to raise the temperature of the cast-iron melt, therefore, the process as described according to the invention is carried out for a period sufficient to attain the desired temperature increase. A temperature increase has been found to be especially advantageous for the production of cast iron with spheroidal (globular) graphite inclusions.

It has been found to be highly advantageous, according to another feature of the invention, when the oxygen is introduced into the cast-iron melt by a supply pipe passing downwardly into the melt and opening at a point below the center of the height thereof. This pipe should be composed of a refractory material or a body coated with a refractory material and best results are obtained when the pipe opens in the horizontal center of the melt at a depth of about two thirds of the path height from the top thereof.

Advantageously the gas-injection pipe for feeding the oxygen into the cast-iron melt is provided at its gas-outlet end with a body of gas-permeable material although it can also be provided over its entire length submerged in the melt from gas-permeable material. In the latter case, the oxygen is not introduced only as a sharply defined stream at the end of the pipe with consequent intensive reaction along the boundaries of this stream, but rather in finely divided form over an extended region of the melt so that the oxidation reaction is effectively distributed similarly. This has been found to reduce the speed of the combustion effect and minimizes smoke development.

The oxygen-introducing pipe can be formed, according to a feature of the invention, in those regions in which it is immersed in the melt from a fireclay-graphite mixture. The latter has been found to be especially effective for the present purposes. The fireclay-graphite mixture can be combined with combustible particles, e.g. sawdust, or other thermally decomposable material, formed into the shape desired and subjected to firing, thereby thermally decomposing the particles and producing a porous body capable of distributing the oxygen into the melt. Above the melt, the pipe can be constituted as a steel tube which can, if desired, be provided with a heat-resistant coating. Naturally, a steel tube can also be used over the portion immersed in the melt if it is coated with a refractory material produced by fireclay and graphite. It is also possible, for the purposes described, to make use of thick-walled clay or fireclay gas inlet pipes.

In order to introduce the oxygen in especially finely divided form into the cast-iron melt, the melt chamber can be provided over all or a portion of its bottom with porous bodies into which the oxygen is fed.

If a flow meter is provided in the gas-feed line or some other measuring device is used to determine the oxygen flow rate, the gas pressure is advantageously adjusted such that the oxygen is supplied at a rate of 0.5 to $2m^3$ (STP = standard temperature and pressure) per minute per ton of the cast-iron melt. In general, within this range, the quantity of oxygen used per minute per ton of the melt is greater with lesser quantities of cast iron in the bath. Experiments have shown that this relationship permits both avoidance of smoke development over the melt and especially effective oxidation requirements for temperature increase of the melt.

According to still another feature of the invention, the oxygen treatment is carried out in the forehearth of a cupola furnace. From the forehearth, cast iron is withdrawn having, following the oxygen treatment of the present invention, the desired characteristics. Consequently, the use of a cupola furnace operated in accordance with the present invention permits the continous production of various cast-iron melts independent of the employed charge.

For example, if it is desired to produce cast iron with globular graphite, before the cast iron melt is subjected to a magnesium treatment, a desulfurization is carried out according to the present invention by oxygen injection. Such a process cannot, because of the temperature requirements, be carried out with conventional cupola furnace operations. However, the injection of oxygen provides a temperature increase of the cast iron melt which is effective for the desulfurization treatment.

Consequently, a melt having a high sulfur content, as is typical for cupola furnace iron, can be desulfurized in the furnace by supplying calcium carbide and nitrogen via the gas-inlet pipe previously described, the resulting temperature loss being made up by subsequent injection of oxygen. Subsequently magnesium treatment can be effected by dropping briquets of 15% magnesium chips, balance gray cast iron, into the melt.

Another advantage of the present invention, especially for the production of malleable iron or cast iron with globular graphite, is the ability to use relatively impure starting materials for producing the basic melt. This significantly reduces the cost of the finished product.

According to another feature of the invention, slag-forming advantages are supplied to the melt to take up the aforementioned oxidation products. We have found that the slagging substances can be, for best results, calcium carbide quartz or lime.

The use of an acid slag promotes the burnoff of manganese while the basic slag promotes the burnoff of silicon. For example, when the desulfurization is carried out it produces cast iron with globular graphite as described above, i.e. with calcium carbide, a slag is produced. The unconsumed basic desulfurizing agent (calcium carbide) can remain as a base slag forming agent to promote silicon removal from the melt.

Depending upon the duration of oxygen feed, the aforementioned modifications of the melt, purification or temperature increase can be obtained. The melt can, as a practical matter, be brought to the desired composition by oxygen treatment even though various impurities can be present originally.

BRIEF DESCRIPTION OF THE DRAWING

The above and other objects, features and advantages of the present invention will become more readily apparent from the following description, reference being made to the accompanying drawing, the sole FIGURE of which is a vertical section through a cupola furnace for carrying out the invention.

SPECIFIC DESCRIPTION

In the drawing we have shown a conventional cupola furnace 1 having a forehearth 2 into which an immersion tube 3 extends so that it opens at 3*a* at a depth d which is approximately two thirds the height D of the cast-iron melt 5 within this bath. The immersion tube 3 can also be porous along its fire clay-graphite zone 6 immersed in the melt, this portion of the tube being connected to a steel tube 7 with a refractory coating as described previously. A valve 11 is here used to control the oxygen flow to establish the maximum oxygen flow rate below that at which incipient smoke formation occurs above the surface of the melt. An oxygen source is connected to tube 7. A fireclay-graphite porous floor 8 may also be provided, if desired, and oxygen can be fed thereto to rise in small bubbles from the bottom of the bath.

A taphole 4 can be provided to discharge the melt. Samples can be removed in the usual manner and a window 9 is provided to permit viewing of the surface 10 of the melt, which is covered by slag to determine incipient smoke formation. Since, in accordance with principles described, fume and smoke formation does not occur, exhaus devices of the type usually required for steel smelting plants can be eliminated. Before tapping, samples are taken and the quality observed to regulate the duration of oxygen introduction.

SPECIFIC EXAMPLES

In a first test, 80 kg (kilogram mass), of a gray cast iron melt is treated over a period of 6 minutes with a total of 0.48 $m^3$ (STP) oxygen using the apparatus illustrated in the drawing.

The usual additives in commercially available form are introduced in an amount of 0.4 percent by weight. Test specimens are cast in rod-shaped casting molds. The oxygen treatment shows the following effect:

TABLE 1

| | Composition by weight (%) | | | | Degree of Saturation | Temperature [° C] | Tensile Strength [N/mm²] |
|---|---|---|---|---|---|---|---|
| | Si | Mn | S | C | | | |
| Before treatment | 2.37 | 0.56 | 0.041 | 3.35 | 0.97 | 1400 | 227 |
| After treatment | 1.94 | 0.42 | 0.040 | 3.28 | 0.9 | 1500 | 306 |

In a further test 80 kg of the gray cast iron melt to which 0.25% by weight aluminum was added, was treated. Cast iron which contains such a high impurity level with aluminum causes problems in the production of globular graphite case iron and malleable iron. The gray cast iron melt was treated as in the first example, although with a higher quantity of oxygen. The relationship between the composition of the melt, the temperature of the cast iron melt and the oxygen injection duration (oxygen quantity) is given in Table 2 below.

TABLE 2

| Blowing Duration (min) | $(O_2)(m^3STP)$ | Temperature (° C) | Composition (%) | | by weight (%) | |
|---|---|---|---|---|---|---|
| | | | Al | C | Si | Mn |
| 0 | 0 | 1380 | 0.25 | 3.52 | 2.33 | 0.79 |
| 2 | 0.334 | 1464 | 0.13 | 3.46 | 2.05 | 0.66 |
| 4 | 0.678 | 1487 | 0.060 | 3.42 | 1.81 | 0.53 |
| 6 | 1.022 | 1491 | 0.012 | 3.32 | 1.67 | 0.42 |

After 6 minutes the temperature was at 111° C. increased. The aluminum content was reduced to such an extend that the composition was suitable for globular graphite case iron. The silicon content was reduced so that the use of additives which increased the silicon content had no effect on the product. The manganese contents also were significantly reduced.

We claim:

1. A process for the treatment of an iron melt, for the production of malleable-iron or globular-graphite iron castings, with oxygen which comprises the steps of:

introducing 0.5 to 2$m^3$ (STP) of oxygen per minute per ton of melt directly into the iron melt in a forehearth of a cupola furnace through a refractory inlet pipe immersed in said melt; and controlling the quantity of oxygen per unit time introduced into said melt such that it is substantially the maximum below that at which smoke development above the surface of said melt occurs as determined by visual observation thereof.

2. The process defined in claim 1 wherein said oxygen is introduced into said melt for a period sufficient to obtain a predetermined value of the saturation degree or carbon equivalent of the cast iron.

3. The process defined in claim 1 wherein the oxygen is introduced into said melt for a period sufficient to reduce the impurity content therein to a predetermined level.

4. The process defined in claim 1 wherein the oxygen is introduced into said melt for a period sufficient to raise the temperature of said melt to a predetermined degree.

5. The process defined in claim 1 wherein the oxygen is introduced into said melt at least in part through a porous floor of a receptacle receiving said melt.

6. A process for the treatment of an iron melt preparatory to casting with oxygen which comprises the steps of:

introducing oxygen directly into the iron melt;

observing the surface of said melt to detect any smoke formation thereabove; and controlling the quantity of oxygen per unit time introduced into said melt such that it is substantially the maximum below that at which smoke development above the surface of said melt occurs, said oxygen being introduced into said melt through a refractory inlet pipe immersed in said melt, said inlet pipe being composed of a gas-permeable material over at least the region immersed in said melt.

7. A process for the treatment of an iron melt preparatory to casting with oxygen which comprises the steps of:

introducing oxygen directly into the iron melt in a forehearth of a cupola furnace through a refractory inlet pipe immersed in said melt; and controlling the quantity of oxygen per unit time introduced into said melt such that it is substantially the maximum below that at which smoke development above the surface of said melt occurs as determined by observation of said surface, said oxygen being introduced into said melt through a refractory inlet pipe immersed in said melt, said inlet pipe having a discharge end formed from gas-permeable material.

8. A process for the treatment of an iron melt preparatory to casting with oxygen which comprises the steps of:

introducing oxygen directly into the cast iron melt in a forehearth of a cupola furnace through a refractory inlet pipe immersed in said melt; and controlling the quantity of oxygen per unit time introduced into said melt such that it is substantially the maximum below that at which smoke development above the surface of said melt occurs as determined by observation of the surface, said oxygen being introduced into said melt through a refractory inlet pipe immersed in said melt, said pipe being composed over at least part of the region immersed in said melt of a fire clay graphite mixture, which can be combined with combustible particles.

9. The process for the treatment of an iron melt preparatory to casting with oxygen which comprises the steps of:

introducing oxygen directly into the iron melt in a forehearth of a cupola furnace through a refractory inlet pipe immersed in said melt; and controlling the quantity of oxygen per unit time introduced into said melt such that it is substantially the maximum below that at which smoke development above the surface of said melt occurs as determined by observation of the surface, the oxygen being introduced into said melt in an amount of 0.5 to 2 $m^3$ (STP) per minute per ton of the melt.

10. A process for the treatment of an iron melt preparatory to casting with oxygen which comprises the steps of:

introducing oxygen directly into the iron melt in a forehearth of a cupola furnace through a refractory inlet pipe immersed in said melt;

controlling the quantity of oxygen per unit time introduced into said melt such that it is substantially the maximum below that at which smoke development above the surface of said melt occurs as determined by observation of said surface; and adding to said melt at least one slag-forming agent to provide a slag layer above said melt.

* * * * *

UNITED STATES PATENT AND TRADEMARK OFFICE

CERTIFICATE OF CORRECTION

PATENT NO. : 4,130,419

DATED : 19 December 1978

INVENTOR(S) : Hummer et al.

It is certified that error appears in the above-identified patent and that said Letters Patent are hereby corrected as shown below:

In the heading, left column, item [75], for the surname of the fourth-named inventor, read:

-- Höllering --

Signed and Sealed this

*Third* Day of *April 1979*

[SEAL]

*Attest:*

RUTH C. MASON
*Attesting Officer*

DONALD W. BANNER
*Commissioner of Patents and Trademarks*